US010174734B2

(12) United States Patent
Reinhardt et al.

(10) Patent No.: US 10,174,734 B2
(45) Date of Patent: Jan. 8, 2019

(54) FUEL-INJECTION SYSTEM HAVING A FUEL-CONDUCTING COMPONENT, A FUEL INJECTOR AND A SUSPENSION MOUNT

(71) Applicant: Robert Bosch GmbH, Stuttgart (DE)

(72) Inventors: Wilhelm Reinhardt, Oetisheim (DE); Volker Scheef, Ludwigsburg (DE); Michael Mayer, Wannweil (DE); Andreas Rehwald, Bietigheim-Bissingen (DE); Jan Herrmann, Stuttgart (DE); Markus Friedrich, Moosburg (DE); Philipp Rogler, Stuttgart (DE); Andreas Glaser, Stuttgart (DE); Hans-Georg Horst, Leonberg (DE); Martin Riemer, Untergruppenbach (DE); Michael Knorpp, Weissach (DE); Michael Fischer, Niefern-Oeschelbronn (DE)

(73) Assignee: ROBERT BOSCH GMBH, Stuttgart (DE)

( * ) Notice: Subject to any disclaimer, the term of this patent is extended or adjusted under 35 U.S.C. 154(b) by 295 days.

(21) Appl. No.: 14/762,618

(22) PCT Filed: Jan. 14, 2014

(86) PCT No.: PCT/EP2014/050563
§ 371 (c)(1),
(2) Date: Jul. 22, 2015

(87) PCT Pub. No.: WO2014/114522
PCT Pub. Date: Jul. 31, 2014

(65) Prior Publication Data

US 2016/0076503 A1 Mar. 17, 2016

(30) Foreign Application Priority Data

Jan. 22, 2013 (DE) ..... 10 2013 200 982

(51) Int. Cl.
*F02M 61/14* (2006.01)
*F02B 1/02* (2006.01)

(52) U.S. Cl.
CPC ..... *F02M 61/14* (2013.01); *F02B 1/02* (2013.01); *F02M 2200/09* (2013.01); *F02M 2200/856* (2013.01)

(58) Field of Classification Search
CPC ..... F02M 61/14; F02M 2200/09; F02M 2200/856; F02B 1/02
See application file for complete search history.

(56) References Cited

U.S. PATENT DOCUMENTS 5,970,953 A 10/1999 Lorraine et al.
6,148,797 A * 11/2000 Gmelin ..... F02M 55/025 123/456

(Continued)

FOREIGN PATENT DOCUMENTS

CN 101280754 A 10/2008
CN 102282359 A 12/2011

(Continued)

OTHER PUBLICATIONS

International Search Report for PCT/EP2014/050563, dated Jun. 16, 2014.

*Primary Examiner* — David Hamaoui
(74) *Attorney, Agent, or Firm* — Norton Rose Fulbright US LLP; Gerard Messina

(57) ABSTRACT

A suspension mount for fuel-injection systems is used to connect a fuel injector to a fuel distributor. A connecting body having an accommodation space is provided, a fuel connector of the fuel injector being able to be disposed at least partially in the accommodation space. In addition, a joining body is provided that is disposed, at least in sections, partially in at least one recess of the connecting body, the recess being connected to the accommodation space, and on (Continued)

which the fuel connector is able to be supported along a longitudinal axis of the accommodation space. The joining body also has an elastically deformable element, the elastically deformable element being disposed in such a way that the joining body permits elastic support of the fuel connector on the connecting body at least along the longitudinal axis. A fuel-injection system having such a suspension mount is also indicated.

7 Claims, 5 Drawing Sheets

(56) References Cited

U.S. PATENT DOCUMENTS

| | | | | |
|---|---|---|---|---|
| 7,334,571 | B1 * | 2/2008 | Beardmore | F02M 61/14 123/456 |
| 7,556,022 | B1 * | 7/2009 | Doherty | F02M 55/004 123/456 |
| 7,765,984 | B2 * | 8/2010 | Fuerst | F02M 55/025 123/456 |
| 8,069,842 | B2 * | 12/2011 | Kannan | F02M 61/14 123/470 |
| 8,087,398 | B2 * | 1/2012 | Harvey | F02M 61/14 123/456 |
| 8,469,004 | B2 * | 6/2013 | Solferino | F02M 61/14 123/470 |
| 8,757,128 | B2 * | 6/2014 | Fischer | F02M 61/14 123/294 |
| 9,291,137 | B2 * | 3/2016 | Schmieder | F01L 1/00 |
| 9,347,411 | B2 * | 5/2016 | Friedrich | F02M 55/004 |
| 2010/0006060 | A1 | 1/2010 | Hoefner | |
| 2014/0284405 | A1 * | 9/2014 | Fischer | F02M 61/14 239/584 |
| 2015/0068497 | A1 * | 3/2015 | Rehwald | F02M 61/14 123/456 |
| 2015/0345445 | A1 * | 12/2015 | Reinhardt | F02M 61/14 239/584 |
| 2016/0003205 | A1 * | 1/2016 | Reinhardt | F02M 61/14 123/470 |
| 2016/0025053 | A1 * | 1/2016 | Reinhardt | F02M 61/14 239/584 |
| 2016/0169176 | A1 * | 6/2016 | Mayer | F02M 61/14 123/189 |

FOREIGN PATENT DOCUMENTS

| | | |
|---|---|---|
| CN | 202545083 U | 11/2012 |
| DE | 102005020380 | 11/2006 |
| EP | 2101097 | 9/2009 |
| WO | WO2013/160064 | 10/2013 |

* cited by examiner

FUEL-INJECTION SYSTEM HAVING A FUEL-CONDUCTING COMPONENT, A FUEL INJECTOR AND A SUSPENSION MOUNT

FIELD OF THE INVENTION

The present invention relates to a suspension mount for fuel-injection systems to connect a fuel injector to a fuel-conducting component, and a fuel-injection system having such a suspension mount. The invention relates especially to the field of fuel-injection systems for mixture-compressing internal combustion engines having externally supplied ignition.

BACKGROUND INFORMATION

German Published Patent Application No. 10 2005 020 380 describes a fuel-injection device having a sound-decoupling type of construction. The known fuel-injection device includes a fuel injector, a mounting bore for the fuel injector in a cylinder head and a fuel distributor having a connection piece. The fuel injector is placed in partially overlapping fashion into the connection piece. A joining body is disposed in such a way that it retains the fuel injector in a manner that the fuel injector and the joining body are inserted free of contact with respect to all surfaces or walls of the mounting bore of the cylinder head not running axially parallel to the fuel injector. In one possible form, the joining body is only a slotted snap ring. The snap ring engages in a tapered section of the inlet connection of the fuel injector. In the connection piece, a groove is provided in which the snap ring is snapped securely and firmly into place. To grasp below the fuel injector, the snap ring has a conical or curved spherical gripping surface. A hold-down device is clamped between the end face of the connection piece and a shoulder on the fuel injector.

The form of the fuel-injection device described in German Published Patent Application No. 10 2005 020 380 has the disadvantage that vibrations can be transmitted between the connection piece, the snap ring and the inlet connection. In particular, vibrations can be transmitted from the fuel injector to the connection piece.

Especially in the case of electromagnetic high-pressure injectors, which may be used in gasoline engines having direct injection, a noticeable and irritating contribution may be made to the overall noise of the engine, which may be described as valve ticking. Such valve ticking results from the rapid opening and closing of the fuel injector, during which the valve needle is moved with strong momentum into the respective end stops. The striking of the valve needle in the end stops leads to briefly acting, but very high contact forces which are transferred in the form of structure-borne noise and vibrations via a housing of the fuel injector to the cylinder head and to a fuel distributor rail. This results in strong noise generation at the cylinder head and at the fuel distributor rail.

SUMMARY

The suspension mount of the present invention and the fuel-injection system of the present invention have the advantage of permitting an improved suspension mount of the fuel injector on the fuel-conducting component. Noise is thereby able to be reduced owing to a targeted decoupling. In particular, a flexible connection of the fuel injector to the fuel-conducting component may be achieved, which permits a reduction of noise in the overall system having the fuel-injection system.

The suspension mount and the fuel-injection system are especially suited for practical applications with respect to direct gasoline injection. In that case, the fuel-conducting component preferably takes the form of a fuel distributor, particularly a fuel-distributor rail. Such a fuel distributor may be used, first of all, to distribute the fuel to several fuel injectors, especially high-pressure injectors. Secondly, the fuel distributor may be used as a shared fuel storage for the fuel injectors. The fuel injectors are then preferably joined to the fuel distributor via corresponding suspension mounts. During operation, the fuel injectors then inject the fuel necessary for the combustion process under high pressure into the respective combustion chamber. In this context, the fuel is compressed via a high-pressure pump and conveyed in flow-rate-controlled fashion via a high-pressure line into the fuel distributor.

The fuel injector, especially the fuel connector, are not components of the suspension mount according to the present invention. In addition, the fuel-conducting component is not necessarily a part of the suspension mount according to the invention. In particular, the suspension mount of the present invention may also be produced and marketed separately from a fuel injector. Moreover, the connecting body of the suspension mount may also be produced and marketed separately from a tubular base member of a fuel-conducting component in the form of a fuel-distributor rail or other parts of the fuel-conducting component. In this context, the connecting body may be preassembled on one or more further parts of the fuel-conducting component, and a connection may be produced by welding, for example.

It is advantageous that the elastically deformable element is disposed in such a way that the joining body permits an elastic support of the fuel connector on the connecting body at least essentially along the longitudinal axis. Thus, the elastic support exists mainly or completely in the axial direction and not in the radial direction.

It is also advantageous that the joining body has a retaining element on the fuel-connector side, and that the fuel connector acts on the elastically deformable element of the joining body via the retaining element on the fuel-connector side. In this case, it is also advantageous that the retaining element on the fuel-connector side has a cross-section that is shaped at least approximately as a semicircular cross-section or U-shaped cross-section It is further advantageous that the elastically deformable element is joined to the retaining element on the fuel-connector side. In this embodiment, the position of the elastically deformable element is retained in advantageous manner by the retaining element on the fuel-connector side.

It is likewise advantageous that the joining body has a retaining element on the connecting-body side, that the retaining element on the connecting-body side is disposed, at least in sections, partially in the recess of the connecting body, and that the elastically deformable element is supported on the connecting body via the retaining element on the connecting-body side. The elastically deformable element is likewise retained in position by the retaining element on the connecting-body side. In this case, it is also advantageous that the retaining element on the connecting-body side has a cross-section that is shaped at least approximately as a semicircular cross-section or U-shaped cross-section. In particular, the elastically deformable element may be joined to the retaining element on the connecting-body side.

Thus, the joining body may be realized as a three-component or three-layer joining body. Each element, namely, the retaining element on the fuel-connector side, the elastically deformable element and the retaining element on the connecting-body side, assumes different functions here. The joining-body retaining element on the fuel-connector side retains the elastically deformable element in position and transfers the forces from the fuel injector to the elastically deformable element. Here, a tolerance compensation is also integrated between the longitudinal axis of the fuel connector and the longitudinal axis of the accommodation space of the connecting body. The elastically deformable element damps the forces transferred from the fuel injector to the fuel-conducting component. The elastically deformable element may thus be realized as a damping element. Preferably, the elastically deformable element is implemented with a stiffness of no more than 50 kN/mm. The stiffness of the elastically deformable element may be set by a selection of material and by a geometry of the elastically deformable element.

In particular, the elastically deformable element may be realized as a disk-shaped and/or annular disk-shaped and/or perforated element. The stiffness may be influenced geometrically by the implementation of the elastically deformable element in the form of a disk or perforated disk.

Moreover, a material having high intrinsic damping may be selected. For example, the elastically deformable element may be made of a plastic, especially PEEK (polyetheretherketone).

In addition, the retaining element on the connecting-body side has its own function. The retaining element on the connecting-body side retains the elastically deformable element in position and transfers the forces from the elastically deformable element to the fuel-conducting component. Moreover, a frictional connection is thereby attained between the fuel injector and the fuel-conducting component.

The joining body may take the form of an annular or part-annular joining body. In particular, the joining body may be implemented here like a circlip. In the case of a part-annular implementation of the joining body, the joining body is disposed in sections partially in the connecting-body recess facing the accommodation space. In this case, the joining body is disposed in sections in the recess, since the joining body is part-annular. Moreover, the joining body is disposed partially in the recess, because the joining body is also disposed partially outside of the recess in order to interact suitably with the fuel connector.

In the case of a form of the joining body as an annular joining body, an entirely partial placement in the recess of the connecting body is also possible. Thus, in both cases, an at least sectional placement in the recess is given.

In addition, the joining body may also be realized as a U-shaped retaining clip. In this embodiment, the joining body may be guided through suitable recesses in the connecting body in order to produce the connection.

DETAILED DESCRIPTION

Figure 1:
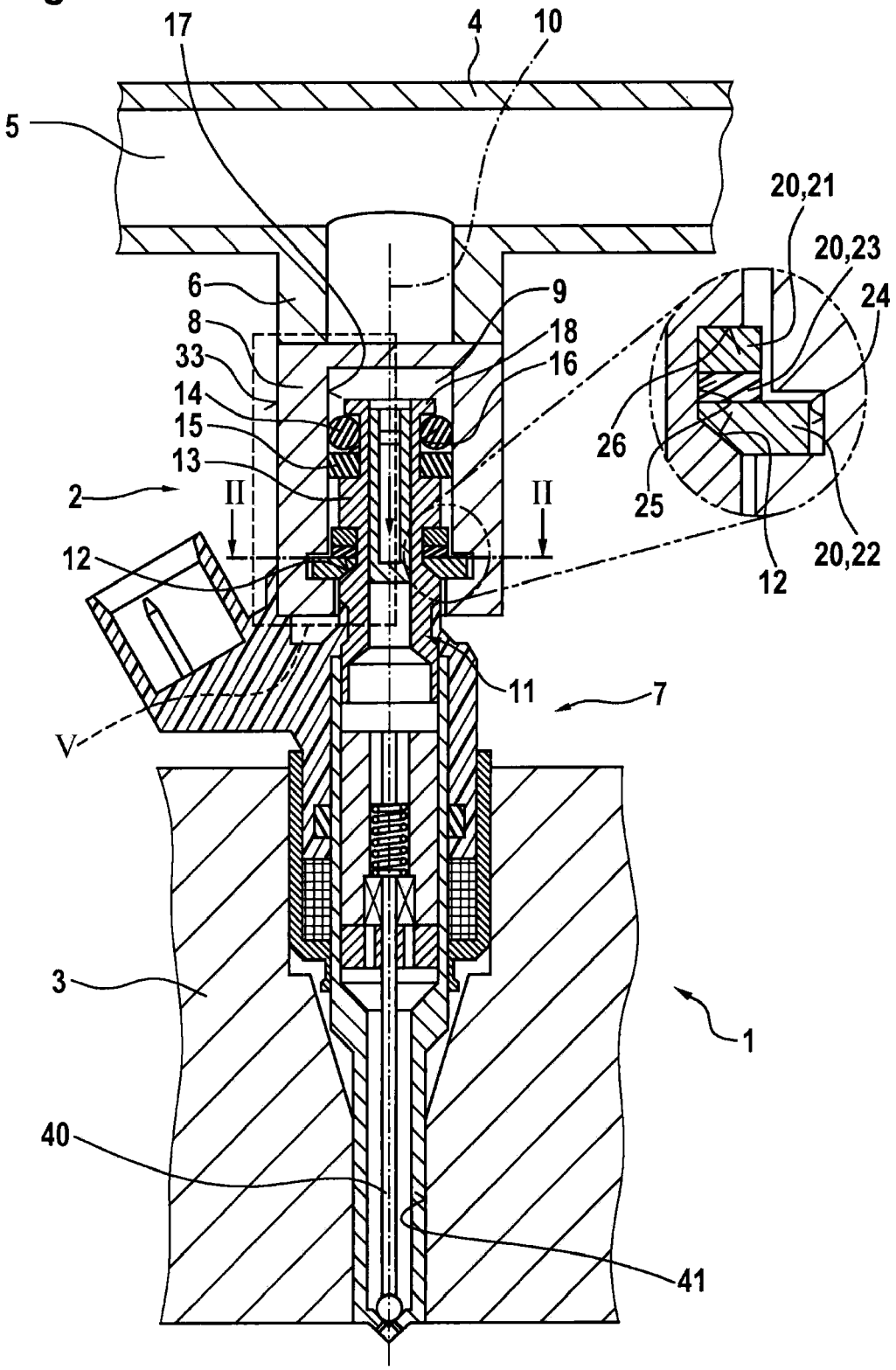
FIG. 1 shows a fuel-injection system having a suspension mount according to a first exemplary embodiment of the invention and an internal combustion engine in a schematic sectional view in part.

FIG. 1 shows a fuel-injection system 1 having a suspension mount 2 according to a first exemplary embodiment, and an internal combustion engine 3 in a schematic sectional view in part. Fuel-injection system 1 may be used especially for high-pressure injection in the case of internal combustion engines 3. In particular, fuel-injection system 1 may be used for mixture-compressing internal combustion engines 3 having externally supplied ignition. Suspension mount 2 is especially suitable for such a fuel-injection system 1.

Fuel-injection system 1 has a fuel-conducting component 4. In this exemplary embodiment, fuel-conducting component 4 takes the form of a fuel distributor 4, especially fuel-distributor rail 4. Fuel distributor 4 has an elongated fuel chamber 5, into which fuel under high pressure is delivered by a high-pressure pump (not shown). Fuel distributor 4 has a plurality of outlets 6, of which only the outlet 6 is shown in FIG. 1 in order to simplify the drawing. A fuel injector 7 is disposed at each of these outlets 6. Fuel injector 7 is joined to outlet 6 of fuel distributor 4 via suspension mount 2. Suspension mount 2 is joined here to fuel distributor 4 in a suitable manner, which is shown only schematically Suspension mount 2 has a connecting body 8 having an accommodation space 9. In this exemplary embodiment, accommodation space 9 is formed symmetrically relative to a longitudinal axis 10 of accommodation space 9 of connecting body 8. Longitudinal axis 10 coincides with a longitudinal axis 10 of fuel injector 7 in this exemplary embodiment.

Fuel injector 7 has a housing 11 having a conical shoulder 12. Conical shoulder 12 is formed on a fuel connector 13 of fuel injector 7.

In the mounted state, fuel connector 13 is situated at least partially in accommodation space 9. Meanwhile, a sealing ring 14 and a support ring 15 are disposed in a circumferential groove 16 of fuel connector 13. Sealing ring 14 abuts inside against fuel connector 13, and outside against an inner wall 17 of connecting body 8. Circumferential groove 16 is located in the area of an end 18 on the inlet side of fuel connector 13, via which fuel is conducted into fuel injector 7 during operation.

In addition, suspension mount 2 has a joining body 20, which in this exemplary embodiment, is formed of a plurality of elements, namely, a retaining element 21 on the fuel-connector side, a retaining element 22 on the connecting-body side and an elastically deformable element 23.

Connecting body 8 has a recess 24 that faces accommodation space 9 and in this exemplary embodiment, takes the form of a circumferential annular groove. Joining body 20 is disposed partially in recess 24 of connecting body 8. In this exemplary embodiment, retaining element 22 on the connecting-body side is situated partially in recess 24 of connecting body 8.

In addition, the fuel connector has a cutout 25 in the area of conical shoulder 12. Along longitudinal axis 10, cutout 25 is bounded on one side by conical shoulder 12 of fuel connector 13, and on the other side by an offset 26. Offset 26 in this exemplary embodiment is oriented in a direction perpendicular to longitudinal axis 10.

Elastically deformable element 23 is positioned between retaining element 21 on the fuel-connector side and retaining element 22 on the connecting-body side. Elastically deformable element 23 permits essentially an elastic deformation of joining body 20 along longitudinal axis 10. Thus, an elastic support of fuel connector 13 on connecting body 8 is made possible along longitudinal axis 10. In this context, elastically deformable element 23 is positioned in such a way that joining body 20 permits an elastic support essentially along longitudinal axis 10.

Elastically deformable element 23 is realized preferably as a disk-shaped and/or annular disk-shaped and/or perforated element 23. Retaining element 21 retains elastically deformable element 23 in position and transfers the forces from fuel connector 13 to elastically deformable element 23. Correspondingly, retaining element 22 retains elastically deformable element 23 in position and transfers the forces from elastically deformable element 23 to connecting body 8, and thus to fuel-conducting component 4. Consequently, the forces transferred from fuel injector 7 to fuel-conducting component 4 are damped. Vibrations are thereby attenuated and noise is reduced.

In this exemplary embodiment, retaining element 22 on the connecting-body side and elastically deformable element 23 of joining body 20 are located outside of recess 24. In a modified embodiment, retaining element 22 on the connecting-body side and/or elastically deformable element 23 may also be located partially in recess 24 of connecting body 8.

Figure 2:
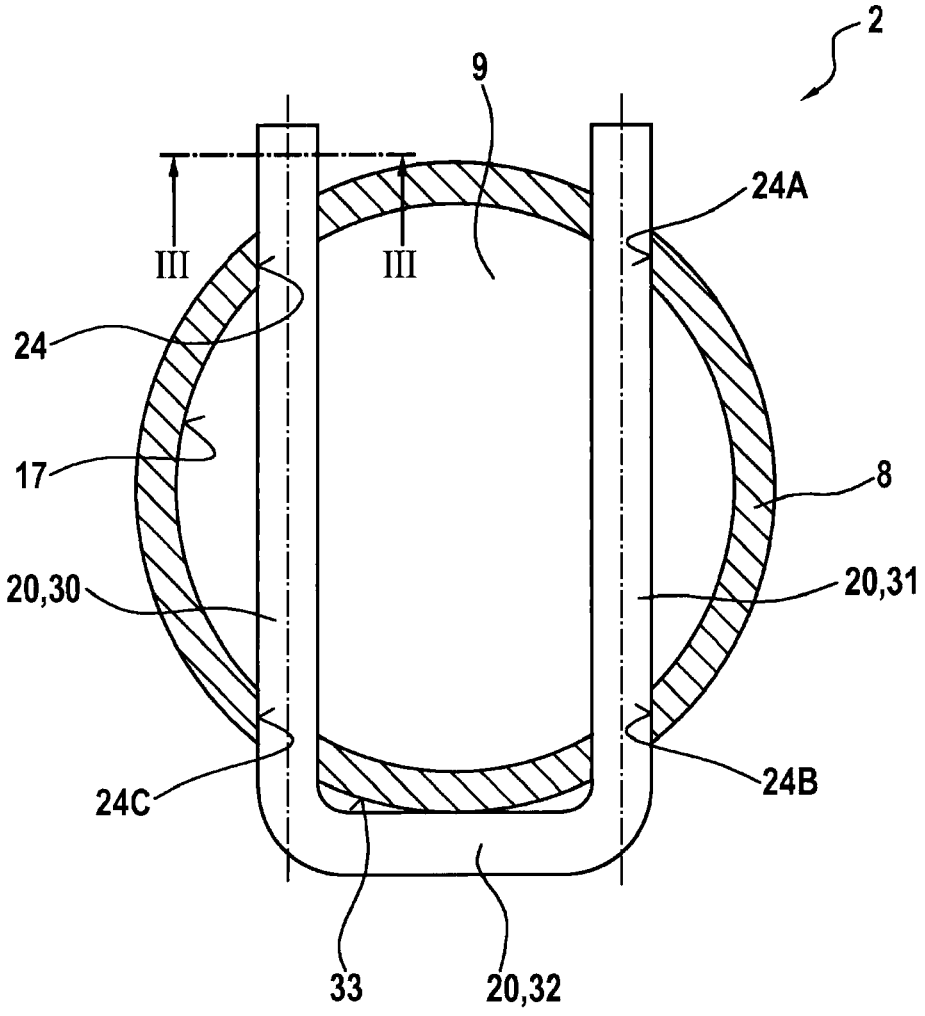
FIG. 2 shows a suspension mount according to a second exemplary embodiment of the invention of the fuel-injection system shown in FIG. 1 in a schematic sectional view along the line of intersection denoted by II.

FIG. 2 shows a suspension mount according to a second exemplary embodiment of fuel-injection system 1 shown in FIG. 1, in a sectional view along the line of intersection denoted by II. In this exemplary embodiment, joining body 20 takes the form of a U-shaped retaining clip 20. In this case, joining body 20 has a first arm 30, a second arm 31 and a joining arch 32. First arm 30 is joined to second arm 31 via joining arch 32. In the assembled state, arms 30, 31 of joining body 20 extend through accommodation space 9 of connecting body 8. Fuel injector 7 having fuel connector 13 is not shown here in order to simplify the drawing. In this exemplary embodiment, a plurality of recesses 24, 24A, 24B, 24C are formed in connecting body 8 and are connected to accommodation space 9. In the assembled state, arms 30, 31 of joining body 20 are guided through recesses 24, 24A, 24B, 24C. Joining arch 32 of joining body 20 touches here on an outer side 33 of connecting body 8.

Figure 3:
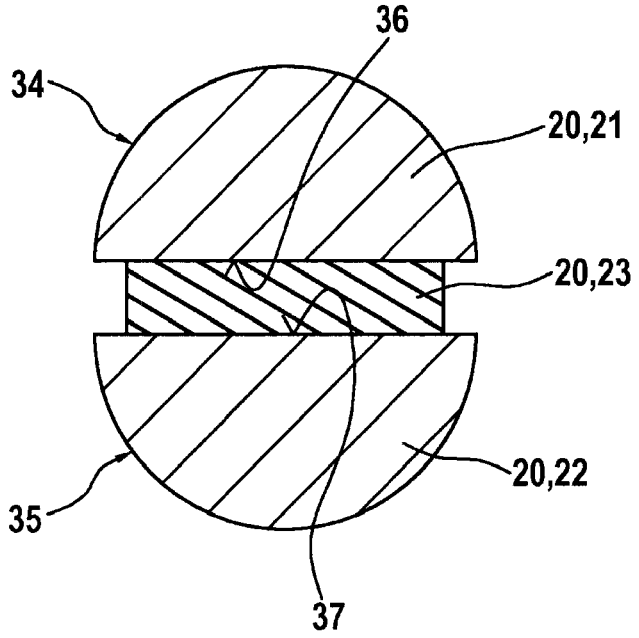
FIG. 3 shows a cross-section of a joining body of the suspension mount shown in FIG. 2 in a schematic representation along the line of intersection denoted by III.

FIG. 3 shows a cross-section of joining body 20 of suspension mount 2 shown in FIG. 2, in a schematic representation along the line of intersection denoted by III. Retaining elements 21, 22 have a semicircular cross-section 34, 35, respectively. Viewed in cross-section, straight edges 36, 37 are apparent here. In this exemplary embodiment, straight edges 36, 37 are thus chords running along the diameter of the circular surfaces underlying cross-sections 34, 35. In a modified embodiment, straight edges 36, 37 may also run along other chords of the underlying circle. In the case of such an embodiment, cross-sections 34, 35 may also be shaped generally as circle segments 34, 35.

Viewed in cross-section, elastically deformable element 23 is situated between straight edges 36, 37 of cross-sections 34, 35. Outer retaining elements 21, 22 are used to position and chamber elastically deformable element 23. In this case, retaining element 21 on the fuel-connector side transfers the force from fuel injector 7 to elastically deformable element 23. Retaining element 22 on the connecting-body side ensures support of elastically deformable element 23 on connecting body 8. Owing to cross-sections 34, 35, the resulting outer contour of joining body 20 is formed in such a way that fuel injector 7 may be somewhat tilted in joining body 20. A tolerance compensation is thereby permitted between the longitudinal axes of fuel injector 7 and accommodation space 9 of connecting body 8, these two longitudinal axes coinciding in FIG. 1 and both being identified by reference numeral 10 in order to simplify the drawing.

In addition, a tolerance compensation is also made possible with regard to a longitudinal axis 40 of a cylinder-head bore 41.

Thus, fuel injector 7 is able to be decoupled from connecting body 8 by elastically deformable element 23. Elastically deformable element 23 may also be formed here from a knitted wire mesh that is placed between retaining elements 21, 22. The joining may be accomplished by pressing and/or welding, for example. Such a knitted wire mesh for forming elastically deformable element 23 may be constructed in such a way that a stiffness of overall joining body 20 of no more than 50 kN/mm is achieved. The construction may be influenced here by a weight, a density and a wire gage of a knitted wire mesh used for elastically deformable element 23. Possible movements between fuel injector 7 and connecting body 8 are thereby decoupled in such a way that the structure-borne noise transmitted from fuel injector 7 to fuel-conducting component 4 is reduced. Moreover, because of the rubbing between the individual wires of the knitted wire mesh, elastically deformable element 23 then damps the movement transmitted from fuel injector 7 to connecting body 8, and with it, the structure-borne noise transmitted, which means less noise develops. However, other embodiments of elastically deformable element 23 are also possible.

Figure 4:
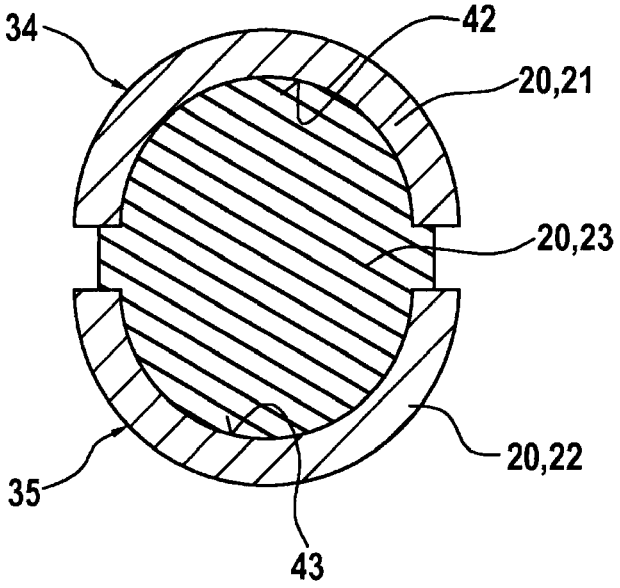
FIG. 4 shows the cross-section shown in FIG. 3 according to a third exemplary embodiment of the invention.

FIG. 4 shows the cross-section, illustrated in FIG. 3, of joining body 20 according to a third exemplary embodiment. In this exemplary embodiment, cross-sections 34, 35 of retaining elements 21, 22 are U-shaped cross-sections 34, 35. Accordingly, in cross-section, a form of arms 30, 31 of two U-shaped shells facing each other therefore results. In this case, elastically deformable element 23 is inserted partially into each of the two interior spaces 42, 43 of retaining elements 21, 22. For example, this assembly may be accomplished by pressing or welding.

Elastically deformable element 23 may thus be joined on one side to retaining element 21 on the fuel-connector side, and on the other side, to retaining element 22 on the connecting-body side.

Figure 5:
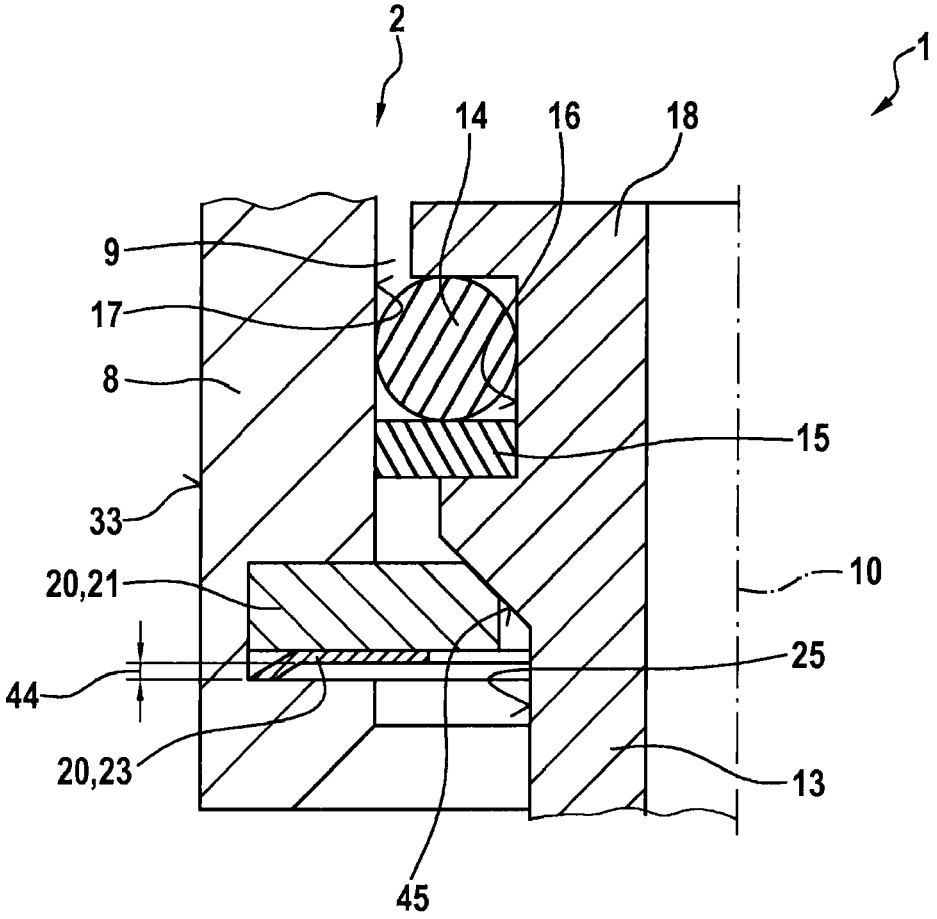
FIG. 5 shows the section of the fuel-injection system denoted by V in FIG. 1 according to a fourth exemplary embodiment of the invention in a schematic sectional view.

FIG. 5 shows the section of fuel-injection system 1 denoted by V in FIG. 1, in a schematic sectional view according to a fourth exemplary embodiment. In this exemplary embodiment, joining body 20 has retaining element 21 on the fuel-connector side and elastically deformable element 23. Thus, a form of joining body 20 made up of two elements, namely, retaining element 21 and elastically deformable element 23, is possible. Retaining element 21 on the fuel-connector side basically ensures the retaining function. Elastically deformable element 23 basically ensures the elastic deformability along longitudinal axis 10. In this case, a low stiffness, especially a stiffness of no more than 50 kN/mm is attainable. The geometry of joining body 20 may be preset here as annular or part-annular. In particular, joining body 20 may be realized here like a circlip. However, joining body 20 may also be U-shaped, as shown correspondingly in FIG. 2.

The advantage of the fourth exemplary embodiment shown in FIG. 5 is that a spring travel is able to be limited. Consequently, this embodiment is especially suitable for fuel-injection systems 1 in which a high or very high fuel pressure is effective during operation. The reason is that given a very large range with respect to system pressures, there is the problem that fuel injector 7 could otherwise execute too great a movement along longitudinal axis 10 in relation to internal combustion engine 3. Too great a movement of this kind is limited, for example, by a form of elastically deformable element 23 as disk spring 23, for the movement along longitudinal axis 10 is thereby limited by a maximum spring travel 44. After passing through spring travel 44, elastically deformable element 23 is then pressed completely, and thus flat, so to speak.

However, in a modified embodiment, elastically deformable element 23 may also be formed in a different manner. In that case, elastically deformable element 23 may also be implemented so that there is no travel limit. In particular, this is possible by a construction of elastically deformable element 23 from an elastically deformable plastic.

Figure 6:
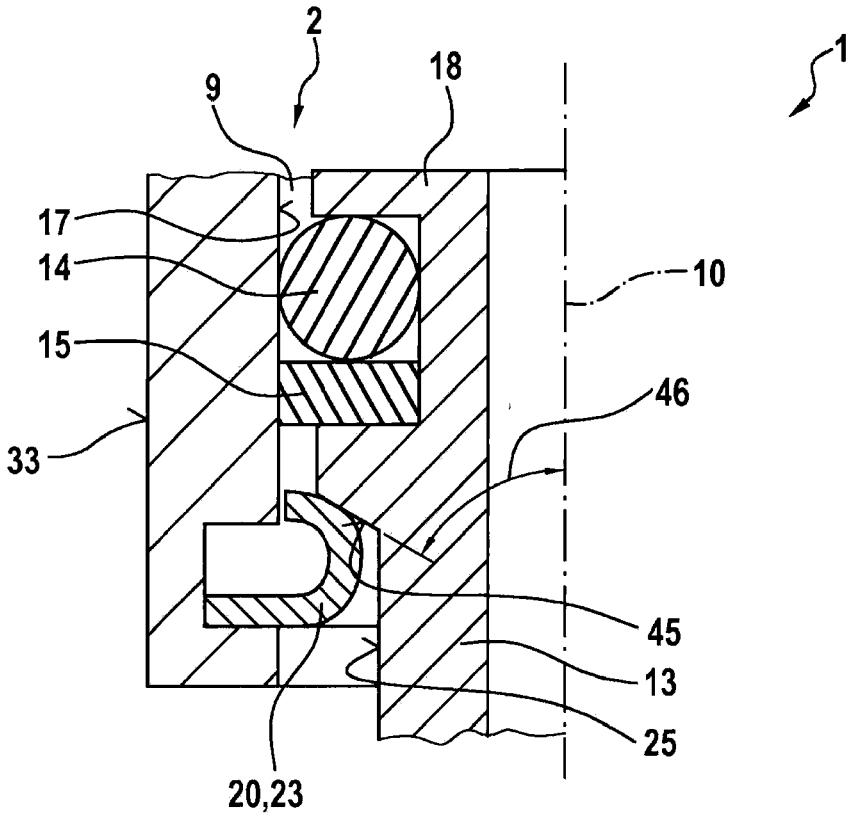
FIG. 6 shows the section of the fuel-injection system shown in FIG. 5 according to a fifth exemplary embodiment of the invention.

FIG. 6 shows the section of fuel-injection system 1 illustrated in FIG. 5 according to a fifth exemplary embodiment. In this exemplary embodiment, joining body 20 is formed of only one element 23, namely, elastically deformable element 23. Thus, all functions for retaining fuel injector 7, especially a tolerance compensation and noise damping, are integrated into one component 23. Elastically deformable element 23 may be annular or part-annular here. In particular, elastically deformable element 23 may be formed like a circlip. However, elastically deformable element 23 may also take the form of a U-shaped retaining clip, as illustrated in FIG. 2.

In this exemplary embodiment, cutout 25 is bounded on one side by conical shoulder 12, and on the other side by a further conical shoulder 45. An opening angle 46 for conical shoulder 45 is selected here in combination with a geometry of elastically deformable element 23 in such a way that an advantageous digressive spring characteristic is attained for the elastic suspension mount of fuel injector 7 on connecting body 8. In a modified embodiment, however, a linear spring characteristic or a progressive spring characteristic may also be attained. This is achievable by a suitable selection of opening angle 46 and a suitable geometric form of elastically deformable element 23.

Thus, a soft suspension mount 2 is able to be realized for securing fuel injector 7 on fuel-conducting component 4. A substantial reduction in noise is thereby possible. This is attainable by a marked reduction of the structure-borne noise transmitted from fuel injector 7 to fuel-conducting component 4. Moreover, this noise-reducing measure may be used in addition to other noise-reducing measures such as a hydraulic throttle at end 18 on the inlet side of fuel connector 13, and a flexible screwed connection of the rail.

Elastically deformable element 23 may be made here of one or more suitable materials. Elastically deformable element 23 may obtain its elasticity by a suitable selection of the material and/or by a suitable geometric form. For example, in the case of the fifth exemplary embodiment described with reference to FIG. 6, elastically deformable element 23 may also be produced from a curved piece of sheet metal, the elasticity being defined by a sheet thickness and a suitable curvature. In this connection, the sheet thickness may also vary locally.

Moreover, in the case of a disk-shaped, elastically deformable element 23, the stiffness may also be influenced by additional geometric elements. For example, a disk-shaped element 23 may be implemented as perforated disk 23 in order to influence the elasticity accordingly.

The present invention is not limited to the exemplary embodiments described.

What is claimed is:

1. A fuel-injection system, comprising:

at least one fuel-conducting component;

at least one fuel injector; and at least one suspension mount, the fuel injector being suspended from the fuel-conducting component via the suspension mount, wherein the suspension mount includes:

a connecting body including an accommodation space, a fuel connector of the fuel injector being able to be disposed at least partially in the accommodation space, and a joining body situated partially in at least one recess of the connecting body, the recess being connected to the accommodation space, wherein:

the fuel connector is able to be supported on the joining body along a longitudinal axis of the accommodation space, the joining body includes an elastically deformable element, the elastically deformable element is disposed in such a way that the joining body permits an elastic support of the fuel connector on the connecting body at least partially along the longitudinal axis, the joining body includes a retaining element on a fuel-connector side, the fuel connector acts on the elastically deformable element of the joining body via the retaining element on the fuel-connector side, and the retaining element on the fuel-connector side and the elastically deformable element are separate parts and are together inserted in a cutout of the fuel connector.

2. The fuel-injection system as recited in claim 1, wherein the elastically deformable element is disposed in such a way that the joining body permits elastic support of the fuel connector on the connecting body along the longitudinal axis.

3. The fuel-injection system as recited in claim 1, wherein the elastically deformable element is joined to the retaining element on the fuel-connector side.

4. The fuel-injection system as recited in claim 1, wherein:

the joining body includes another retaining element on a connecting-body side, the other retaining element on the connecting-body side is disposed partially in the recess of the connecting body, and the elastically deformable element is supported on the connecting body via the other retaining element on the connecting-body side.

5. The fuel-injection system as recited in 4, wherein the elastically deformable element is joined to the other retaining element on the connecting-body side.

6. The fuel-injection system as recited in claim 1, wherein the elastically deformable element includes at least one of a disk-shaped element, an annular disk-shaped element, and a perforated element.

7. The fuel-injection system as recited in claim 1, wherein the joining body is formed as an annular joining body or a part-annular joining body.

* * * * *